US008727487B2

(12) United States Patent
Nukui

(10) Patent No.: US 8,727,487 B2
(45) Date of Patent: May 20, 2014

(54) IMAGE RECORDING APPARATUS

(71) Applicant: Kosuke Nukui, Nagoya (JP)

(72) Inventor: Kosuke Nukui, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 28 days.

(21) Appl. No.: 13/772,634

(22) Filed: Feb. 21, 2013

(65) Prior Publication Data

US 2013/0215193 A1 Aug. 22, 2013

(30) Foreign Application Priority Data

Feb. 21, 2012 (JP) ..... 2012-035482

(51) Int. Cl.
*B41J 2/165* (2006.01)

(52) U.S. Cl.
USPC ..... 347/33; 347/23; 347/29

(58) Field of Classification Search
USPC ..... 347/7, 14, 21–23, 29, 33, 36, 89, 90
See application file for complete search history.

(56) References Cited

U.S. PATENT DOCUMENTS 8,038,251 B2 * 10/2011 Inaba ..... 347/19
2009/0289985 A1 11/2009 Sumida et al.

FOREIGN PATENT DOCUMENTS

JP 2006-240147 A 9/2006
JP 2009-279777 A 12/2009
JP 2011-128761 A 6/2011

* cited by examiner

*Primary Examiner* — Thinh Nguyen
(74) *Attorney, Agent, or Firm* — Baker Botts L.L.P.

(57) ABSTRACT

When a jam detector detects jamming, forced discharging from a head and wiping of an ejection surface are performed after a recording medium jammed is removed from a conveyor. When the count on a jam counter matches with any of one or more thresholds, at least the number of times the wiping is executed after the jammed recording medium is removed from the conveyor is greater than that executed when the count on the jam counter does not match with any of one or more thresholds.

13 Claims, 14 Drawing Sheets

(a)

NORMAL PURGE OPERATION GROUP (b)

JAM PURGE OPERATION GROUP

IMAGE RECORDING APPARATUS

CROSS REFERENCE TO RELATED APPLICATION

The present application claims priority from Japanese Patent Application No. 2012-35482, which was filed on Feb. 21, 2012, the disclosure of which is herein incorporated by reference in its entirety.

BACKGROUND OF THE INVENTION

1. Field of the Invention

The present invention relates to an image recording apparatus configured to eject a liquid from ejection openings to a recording medium.

2. Description of the Related Art

To restrain dots formed on a sheet from spreading, there has been known a printer which applies, prior to ejection of the ink from the head, a pre-process liquid which condenses or extracts a coloring component from the ink to portions of the sheet where the dots are to be formed.

SUMMARY OF THE INVENTION

If a sheet is jammed in the above-mentioned printer, the pre-process liquid having been applied to the sheet may remain on a side surface of the head, and another sheet subsequently jammed may cause migration of the remaining pre-process liquid to the ejection surface, thus causing the pre-process liquid to contact the ink. In such a case, the coloring component of the ink condensed or extracted may partially or entirely plugs the ejection openings. The similar problem may take place in a printer configured to eject inks of a plurality of colors.

An image recording apparatus includes a conveyor, an application unit, a liquid ejection head, a force-discharger, a wiping mechanism, a jam detector, a jam counter, and a controller. The conveyor conveys a recording medium in a conveyance direction. The application unit applies a first liquid to the recording medium. The liquid ejection head has a liquid ejection surface on which liquid ejection openings for ejecting a second liquid to the recording medium are opened, and is provided downstream of the application unit relative to the conveyance direction. The force-discharger causes forced discharging of the second liquid from the second liquid ejection opening. The wiping mechanism wipes the liquid ejection surface. The jam detector detects jamming of the recording medium in the conveyor. The jam counter counts the number of times the jamming has detected by the jam detector. The controller controls the force-discharger and the wiping mechanism so that, when the jam detector detects the jamming, the forced discharging and the wiping is executed after the recording medium having jammed is removed from the conveyor. When the count on the jam counter matches with any of one or more thresholds, the controller controls the force-discharger and the wiping mechanism so that, at least the number of times the wiping is executed after the jammed recording medium is removed from the conveyor is greater than that executed when the count on the jam counter does not match with any of one or more thresholds.

An image recording apparatus, includes a conveyor, an application unit, a liquid ejection head, a force-discharger, a wiping mechanism, a detection sensor, and a controller. The conveyor is configured to convey a recording medium in a conveyance direction. The application unit is configured to apply a first liquid to the recording medium. The liquid ejection head has a liquid ejection surface on which liquid ejection openings for ejecting a second liquid to the recording medium are opened, and is provided downstream of the application unit relative to the conveyance direction. The force-discharger is configured to cause forced discharging of the second liquid from the liquid ejection openings. The wiping mechanism is configured to wipe the liquid ejection surface. The detection sensor is configured to detect the presence and absence of the recording medium. The controller is configured to control the force-discharger and the wiping mechanism. The controller determines that the recording medium has jammed based on a detection result by the detection sensor, counts the number of times the jamming has been detected, controls the force-discharger and the wiping mechanism so that, when jamming of the recording medium is determined to have occurred, the forced discharging and the wiping are executed after the recording medium is removed from the conveyor, controls the force-discharger and the wiping mechanism so that, when the count on the jam counter matches with any of one or more thresholds, at least the number of times the wiping is executed after the jammed recording medium is removed from the conveyor is greater than that executed when the count on the jam counter does not match with any of one or more thresholds.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

First Embodiment

Figure 1:
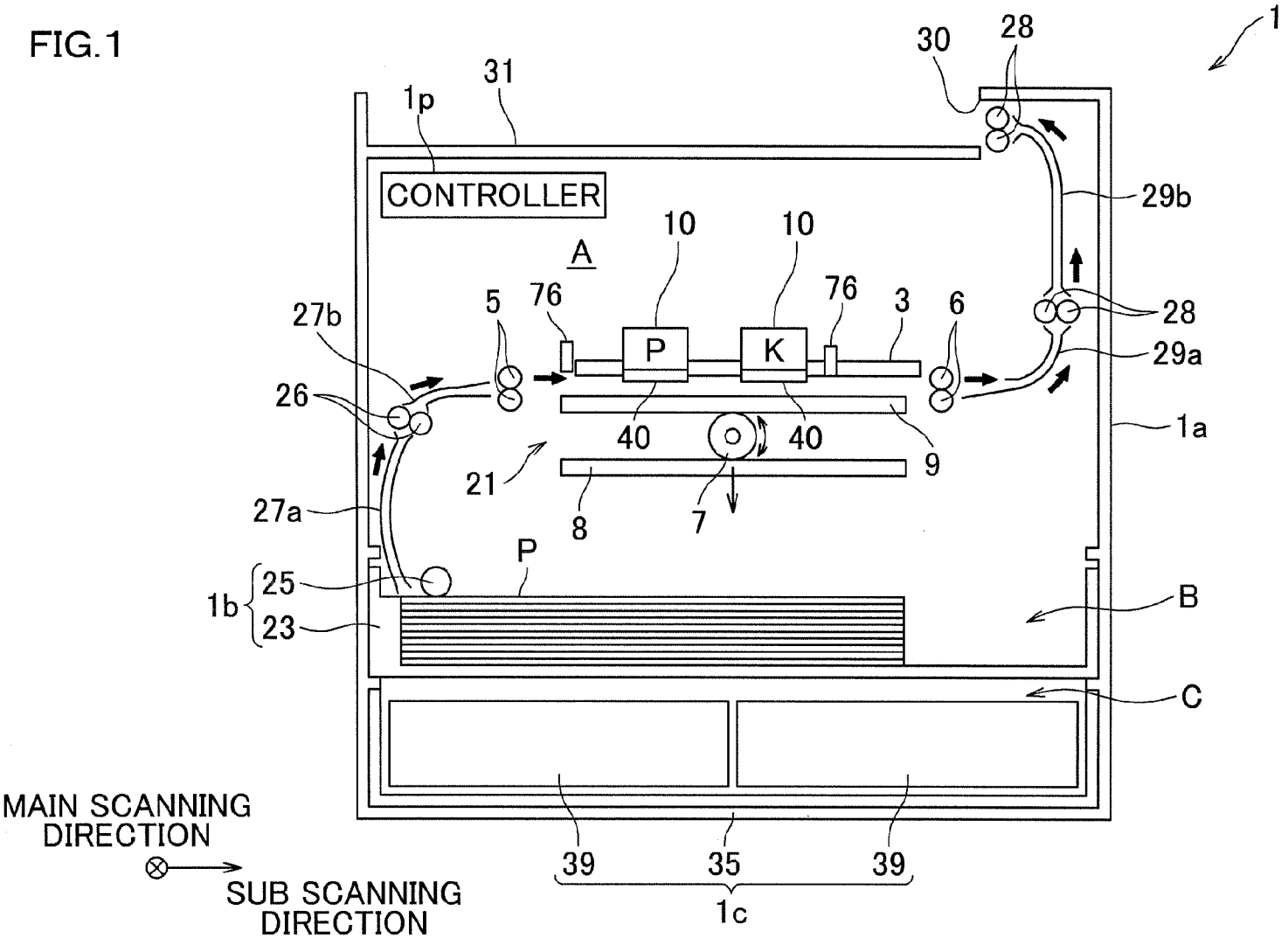
FIG. 1 is a schematic side view showing an inside structure of an inkjet printer related to a first embodiment of the present invention.

The following describes an overall structure of an inkjet printer 1 related to a first embodiment of the present invention. As shown in FIG. 1, the printer 1 has a housing 1*a* having a rectangular parallelepiped shape. In an upper part of a top plate of the housing 1*a* is provided an output-sheet receiver 31. The inside space of the housing 1*a* is parted into spaces A, B, and C sequentially from the top. In the spaces A and B is formed a sheet conveyance path leading to the output-sheet receiver 31. Along the sheet conveyance path are disposed a plurality of jam detection sensors 76. The space C accommodates therein two cartridges 39 each serving as a liquid supply source for heads 10.

Figure 8A:
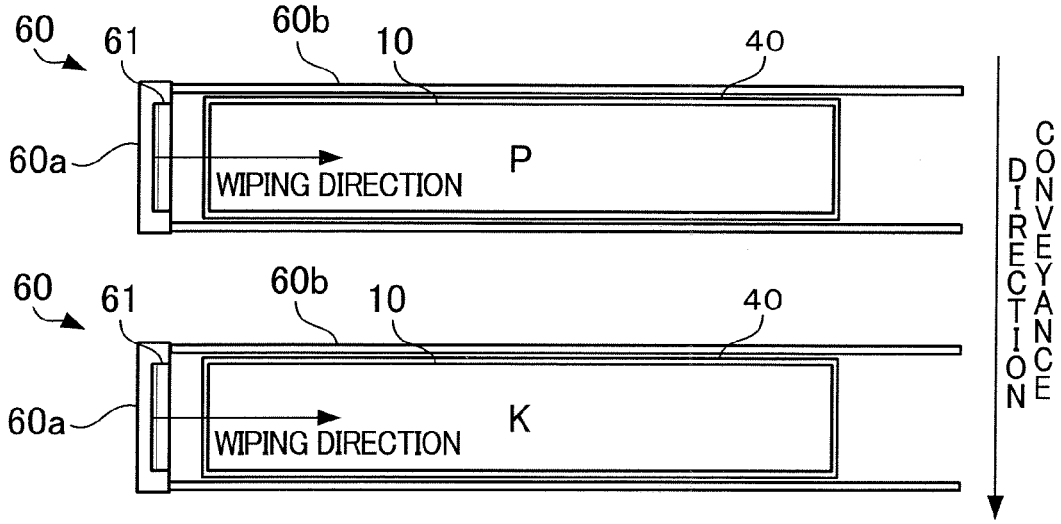
FIGS. 8A, 8B, 8C are each a schematic view of a wiping mechanism in the printer shown in FIG. 1.
Figure 8B:
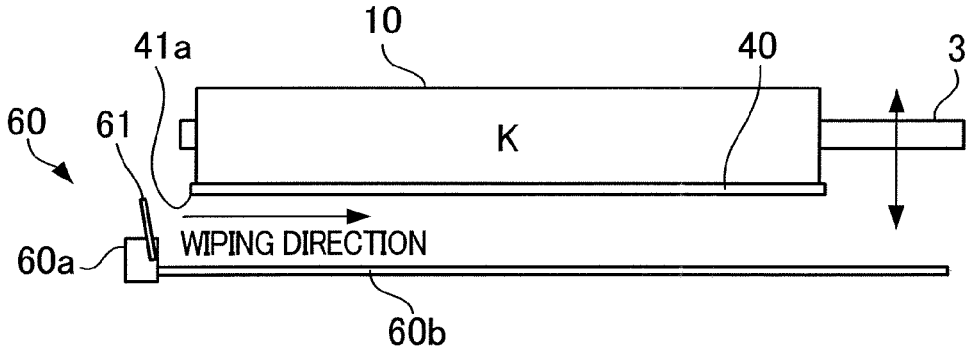

In the space A are disposed two heads 10, a conveyance unit 21 which conveys a sheet P, a guide unit which guides the sheet P, a humidifier 50 (see FIG. 5) used in a humidifying operation, and a wiper-moving mechanism 60 (see FIG. 8A and FIG. 8B). As later-mentioned, the under surface of each head 10 serves as an ejection surface 10*a* which is provided with a plurality of ejection openings 14*a*. In the upper part of the space A is disposed a controller 1*p* which controls operations of each part of the printer 1, thus administrating the operations of the entire printer 1.

The controller 1*p* controls, based on image data supplied from an external apparatus, conveyance of sheet P, ink ejection synchronized with the conveyance of the sheet P, maintenance for restoring and/or maintaining the ejection performance, or the like performed by each part of the printer 1. The maintenance includes a flushing (preliminary ejection) operation, a purge operation, a wiping operation, and a humidifying operation. The flushing operation is an ink discharging operation taking place at a part of or all of the ejection openings 14*a*, and one or more later-mentioned actuators related to discharging of ink are driven. In the flushing operation, a predetermined number of ink droplets are ejected from the ejection openings 14*a* based on the flushing data (data separate from the image data). The purge operation is an ink discharging operation taking place at all of the ejection openings 14*a*, and is executed by driving a purge pump 69 (see FIG. 9) connected to a passage upstream of the head 10. With a pressure applied by the purge pump 69, a predetermined amount of ink is discharged from the ejection openings 14*a*. The wiping operation is a cleaning operation for the ejection surface 10*a*, and wipes the ejection surface 10*a* with a use of a wiper 61 (see FIG. 8A and FIG. 8B). This operation is performed after each ink discharging operation. The humidifying operation is a rehydrating operation for the ejection openings 14*a*, and supplies a humidified air to an ejection space S1 (see FIG. 5) facing the ejection surface 10*a*.

The conveyance unit 21 has a platen 9, pairs of conveyance nip rollers 5 and 6, and the like. The pairs of conveyance nip rollers 5 and 6 are disposed on both sides of the platen 9 relative to a conveyance direction. Each pair is a pair of roller members, and sandwiches a sheet P from the top and bottom and conveys the sheet P in the conveyance direction. The pair of conveyance nip rollers 5 supplies the sheet P on to the platen 9. The pair of conveyance nip rollers 6 feeds the sheet P from the platen 9 to the output-sheet receiver 31.

The platen 9 structures the sheet conveyance path and is disposed so as to surface the ejection surface 10*a* with a predetermined space therebetween at the time of printing. As shown in FIG. 1, the platen 9 also structures, along with a reversing mechanism 7 and a glass table 8, a facing member switching mechanism. During the maintenance, the reversing mechanism 7 is driven and the glass table 8 is disposed to surface the ejection surface 10*a*, in place of the platen 9. The facing member switching mechanism is capable of ascending and descending. While the mechanism is descended, the platen 9 and another facing member (glass table 8) are switched over.

Each head 10 is a line head having a rectangular parallelepiped shape which is long in the main scanning direction. The under surface of each head 10 serves as the ejection surface 10*a* having a number of ejection openings 14*a* (see FIG. 3 and FIG. 4) opened. To the upstream relative to the conveyance direction is disposed a head 10(P), and to the downstream is disposed a head 10(K). Note that the main scanning direction is a direction parallel to the horizontal plane and perpendicular to the conveyance direction of the sheet P by the conveyance unit 21. The sub scanning direction is a direction parallel to the conveyance direction of the sheet P by the conveyance unit 21

At the time of printing, pre-coat droplets are ejected from the head 10(P) to an image formation area of the sheet P, and ink droplets ejected from the head 10(K) are overlapped with the pre-coat droplets. For example, a pre-coat liquid is a liquid containing cation-based macromolecules or a multivalent metallic salt such as magnesium salt. Mixing the pre-coat liquid with the colorant of the ink generates an insoluble or hardly soluble metal complex or the like. When the ink is a pigment ink, the above mixture causes condensation of the coloring material of the ink. When the ink is a dye ink, the above mixture causes extraction of the coloring material. This way the ink is restrained from spreading on the sheet. Further, the ink hardly permeates through the sheet P and more stably settled on the surface. As the result, the image quality is improved.

The two heads 10 are supported by the housing 1*a* via a head holder 32. At this point, the ejection surface 10*x* surfaces the platen 9 or the glass table 8 with a predetermined space therebetween. Further, the head holder 3 has an annular cap 10 and a pair of joint 51 (see FIG. 6) for each of the heads 10.

Figure 9:
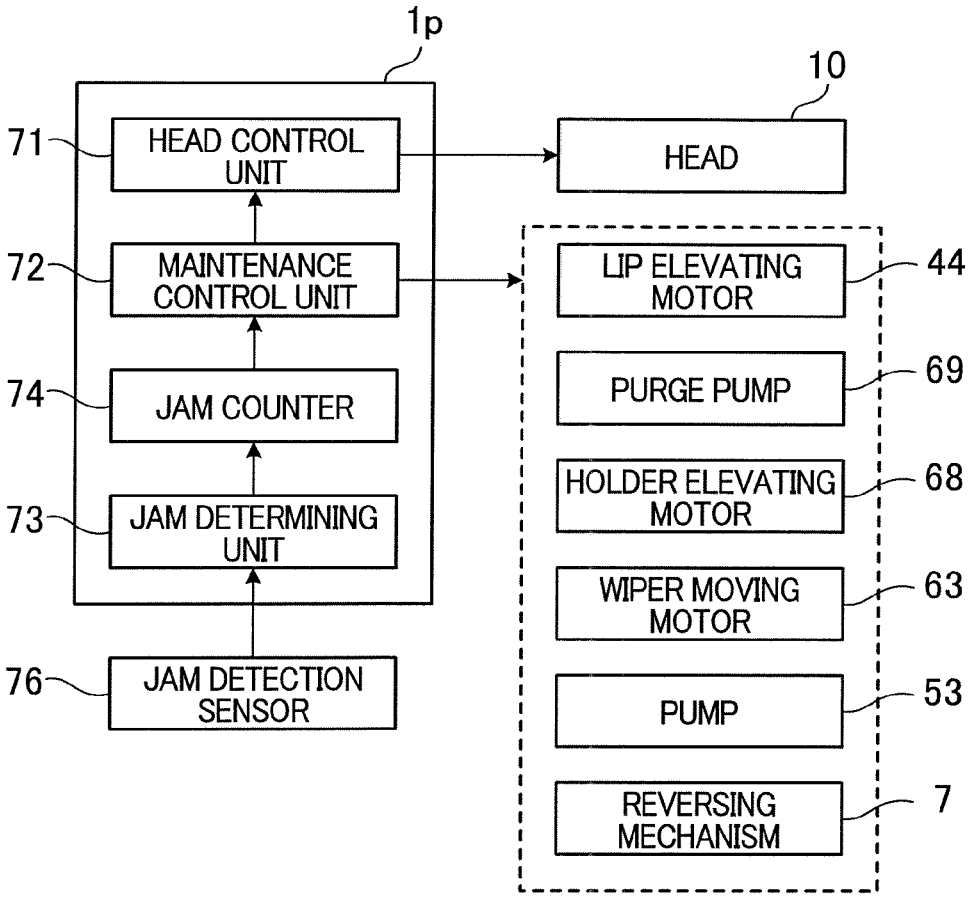
FIG. 9 is a functional block diagram of a controller in the printer shown in FIG. 1.

The head holder 3 is ascended and descended by the holder elevation mechanism whose drive force is a holder elevating motor 68 (see FIG. 9). The head holder 3 is structured on as to be disposed in three positions (i.e., from the bottom, a printing position, a wiping position, and a retracted position: see FIGS. 10A to 10C). The printing position is a position where the heads 10 eject droplets to the sheet P. The wiping position is a position higher than the printing position, and is a position where the wiper 61 wipes the ejection surface 10*a*. The retracted position is a position higher than the wiping position, and is a position where the wiper 61 does not contact the ejection surface 10*a*.

The guide unit includes an upstream guide unit (upstream guide section) and a downstream guide unit which are disposed to sandwich the conveyance unit 21. The upstream guide unit has two guides 27*a* and 27*b* and a pair of feed rollers 26. The upstream guide unit connects the sheet-feeder unit 1*b* with the conveyance unit 21. The downstream guide unit has two guides 29*a* and 29*b* and two pairs of feed rollers 28. The downstream guide unit connects the conveyance unit 21 with the output-sheet receiver 31.

In the space B is disposed a sheet-feeder unit 1*b*. The sheet-feeder unit 1*b* is structured by a sheet-feeder tray 23 and a pickup roller 25, and the sheet-feeder tray 23 is detachable from the housing 1*a*. The sheet-feeder tray 23 is a box-like member whose top is opened, and is capable of accommodating a plurality of sizes of sheets P. The pickup roller 25 feeds out the uppermost one of the sheets P in the sheet-feeder tray 23 and supplies the sheet P to the upstream guide unit.

As described above, in the spaces A and B are formed the sheet conveyance path extending from the sheet-feeder unit 1*b* to the output-sheet receiver 31 via the conveyance unit 21. Based on a printing command received from an external apparatus, the controller 1*p* drives a not-shown sheet feeding motor for the pickup roller 25, a not-shown feeding motor for the feed rollers of each guide unit, and a conveyance motor. The sheet P fed out from the sheet-feeder tray 23 is supplied to the conveyance unit 21 by the feed rollers 26. When the sheet P passes immediately below the heads 10 in the sub scanning direction, the pre-coat liquid and the ink are successively ejected, thereby forming an image on the sheet P. The sheet P is then conveyed upward by the two pairs of feed rollers 28. The sheet P is then discharged to the output-sheet receiver 31 from an opening 30 in the upper portion.

In the space C is disposed an ink unit 1*c* which is detachable from the housing 1*a*. The ink unit 1*c* has a cartridge tray 35, two cartridges 39 stored in the tray 35 side by side, and a not-shown water tank 54 (see FIG. 5). Each cartridge 39 supplies the pre-coat liquid or the ink to the corresponding head 10 via a not-shown tube.

Figure 2:
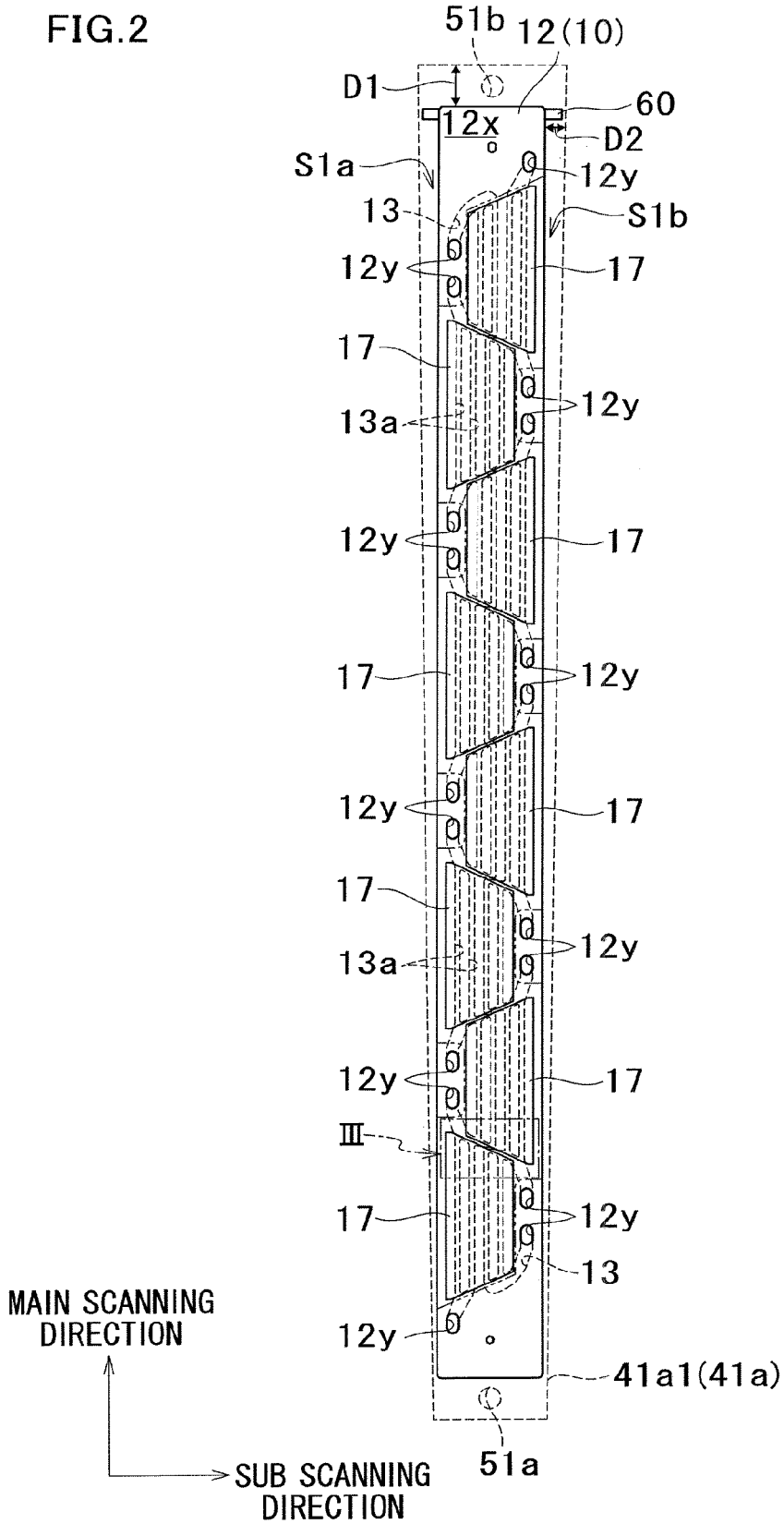
FIG. 2 is a plan view of a passage unit and an actuator unit of an inkjet head in the printer shown in FIG. 1.
Figure 3:
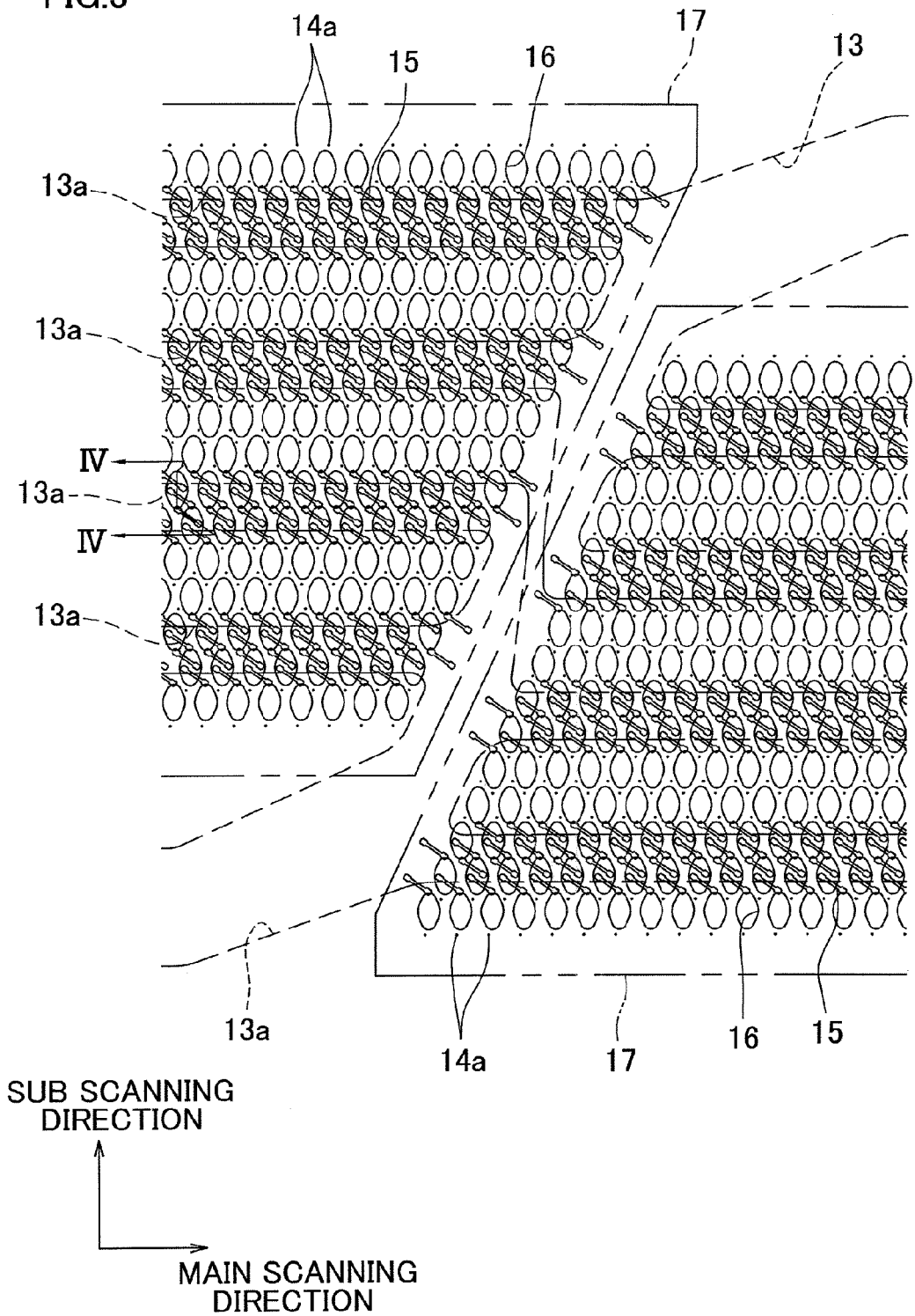
FIG. 3 is an enlarged view of an area III surrounded by a single-dashed line in FIG. 2.

Next, the following describes the structure of each head 10, with reference to FIG. 2 to FIG. 7. In FIG. 3, pressure chambers 16 and apertures 15 which are under actuator units 17 and which should be drawn in dotted lines are drawn in solid lines.

The head 10 is a layered member in which a passage unit 12 having a plurality of actuator units 17, a reservoir unit 11 (see FIG. 6), a circuit substrate, and the like are stacked from the bottom in this order. On the top surface of the passage unit 12 is fixed eight actuator units 17. The actuator units 17 and the circuit substrate are connected with each other via an FPC (Flexible Printed Circuit) 19 having thereon a not-shown driver IC.

Figure 4:
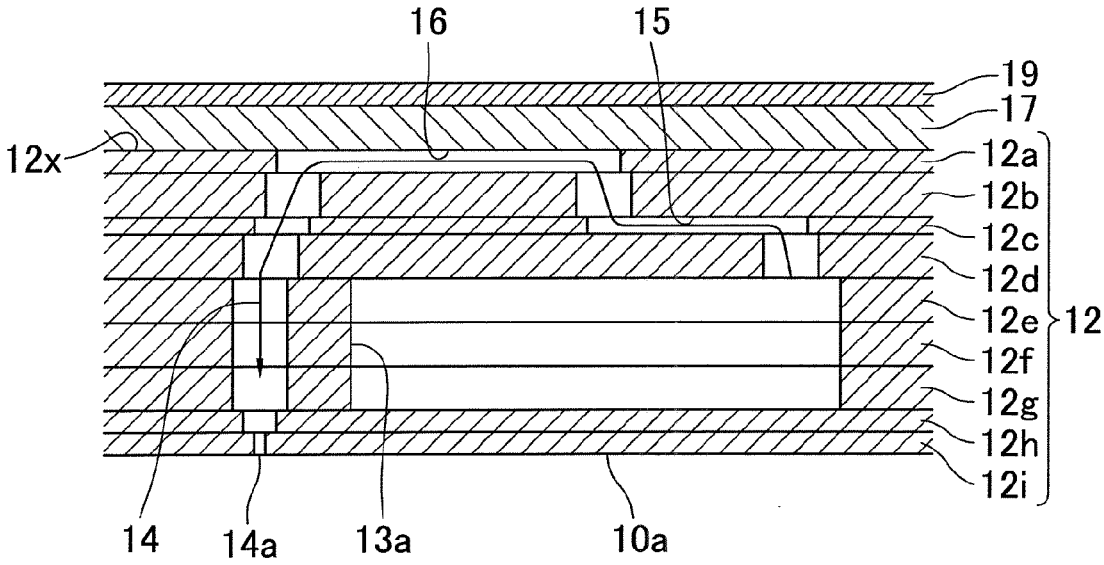
FIG. 4 is a partial cross sectional view taken along the line IV-IV of FIG. 3.

As shown in FIG. 4, the passage unit 12 is a layered member having nine metal plates 12*a* to 12*i* stacked successively, and has a rectangular shape in plan view. Inside the passage unit 12 is formed a plurality of manifold channels 13 whose respective one ends are a plurality of openings 12*y* on the top surface 12*x*; a plurality of sub manifold channels 13*a* branched off from the manifold channels 13; and a plurality of individual ink passages 14 extending from the outlets of the sub manifold channels 13*a* to the ejection openings 14*a* via pressure chambers 16. The individual ink passage 14 is formed for each of the ejection openings 14*a* and includes an aperture (an aperture for adjusting the passage resistance) 15. In each area of the top surface 12*x* where the actuator unit 17 is adhered, a plurality of pressure chambers 16 are opened. In each area of the ejection surface 10*a* facing the area where the actuator unit 17 is adhered, the ejection openings 14*a* are disposed in matrix.

The eight actuator units 17 are disposed in two rows, in a zigzag manner, so as to avoid the openings 12*y*. Each actuator unit 17 is a group of piezoelectric actuators formed for the ejection openings 14*a*, respectively, and covers the pressure chambers 16. Each actuator is a unimorph actuator, and includes a stack of piezoelectric layers, individual electrodes on the surface of the outermost layer facing the pressure chambers 16, and a common electrode which, along with the individual electrodes, sandwiches a single piezoelectric layer outermost layer). Each piezoelectric layer and the common electrode are each formed as a single plate extending throughout the entire actuator unit 17.

Inside the reservoir unit 11 is formed an ink passage having a reservoir. In the reservoir is temporarily stored the ink from the cartridge 39. The under surface of the reservoir unit 11 has recesses and projections. Each projection has an opening serving as one end of the ink passage, in a position corresponding to the opening 12*y*. This way, the reservoir is in communication with the ink passage inside the passage unit 12 via the opening 12*y*. Each recess is provided so as to surface the actuator unit 17, and forms a gap between the reservoir unit 11 and the passage unit 12. The depth of each recess is such that a slight gap is formed between the top surface of the actuator unit 17 and the bottom surface of the recess.

In the circuit substrate, various drive signals from the controller 1*p* are adjusted. The drive signals are transmitted to the actuator 17 via the driver IC mounted on the FPC. When a drive signal is output, the actuator causes variation in the volume of the pressure chamber 16. This causes ejection of droplets from the ejection opening 14*a*.

Figure 5:
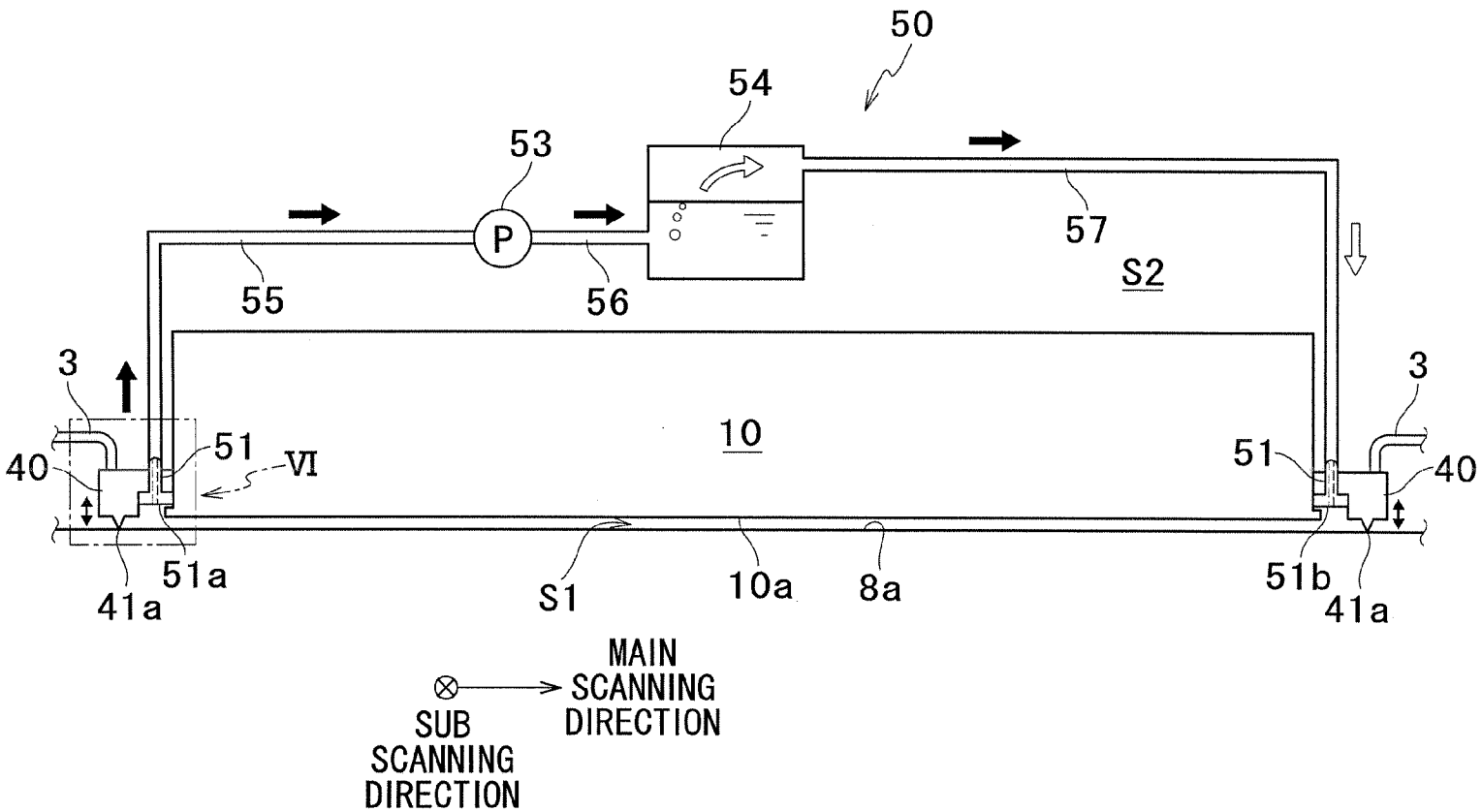
FIG. 5 is a schematic view showing a head holder and a humidifier in the printer shown in FIG. 1.
Figure 6:
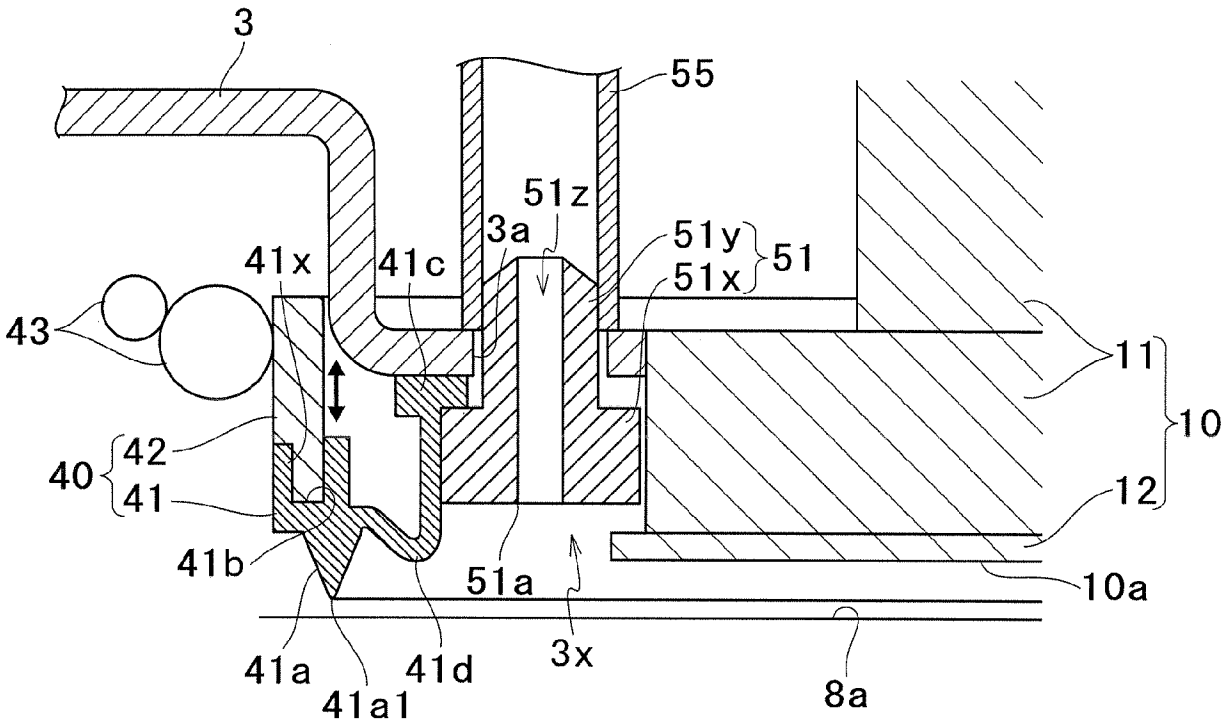
FIG. 6 is a partial cross sectional view showing an area VI surrounded by a single dashed line in FIG. 5.

Next, the following describes the structure surrounding the head holder 3, with reference to FIG. 2, FIG. 5, and FIG. 6.

The head holder 3 is a frame made of a metal or the like, and keeps a predetermined positional relationship of the ejection surface 10*a* with respect to the glass table 8 or the platen 9. Maintenance-related members which are provided to each head 10 are supported by the head holder 3. The maintenance-related members include a part of the humidifier 50 (a pair of joints 51 described below) and a cap 40 (an annular member surrounding the outer circumference of the ejection surface 10*a*).

The pair of joints 51 are disposed closely to both ends of the head 10 relative to the main scanning direction. In the humidifying operation, the joint 51 on the right supplies a humidified air to the ejection space S1, as shown in FIG. 5. An opening 51*b* provided to the under surface of the joint 51 serves as a supply port of the humidified air to the ejection space S1. The joint 51 on the left collects the air from the ejection space S1. An opening 51*a* provided to the under surface of the joint 51 serves as a ventilation port of the air from the ejection space S1. As shown in FIG. 6, the joint 51 has a cylindrical base end part 51*x* with a large diameter, and a cylindrical part 51*y* with a small diameter connected to the top portion of the base end part 51*x*. A hollow space 51*z* penetrates the both portions 51*x* and 51*y* in the up and down directions. The cylindrical part 51*y* is inserted into a through hole 3*a* of the head holder 3, and is connected to the tube 55 via its upper end portion whose diameter is reduced towards its leading end. Between the cylindrical part 51*y* and the through hole 3*a* is formed a slight gap. To this gap is filled a sealing material, or the like.

The cap 40 has an elastic member 41 and a movable part 42 capable of ascending and descending. The elastic member 41 is made of an elastic material such as rubber or the like, and is structured by four parts (a base part 41*x*, a projecting part 41*a*, a fixed part 41*c*, and a connecting part 41*d*), as shown in FIG. 6.

Of these parts, the fixed part 41*c* has a T-shaped cross section, and its flat upper end surface is adhered to the head holder 3. The fixed part 41*c* surrounds the entire circumference of the head 10 (ejection surface 10*a*). Nearby the through hole 3*a*, the fixed part 41*c* is partially sandwiched between the head holder 3 and the joint 51 (base end part 51*x*). The connecting part 41*d* connects the fixed part 41*c* inside with the base part 41*x* outside. The connecting part 41*d* is curved and extended between these two portions. With ascending or descending of the base part 41*x* by the movable part 42, the connecting part 41*d* varies its shape. The projecting part (lip) 41*a* projects downwards from the under surface of the base part 41*x*, and is tapered towards the bottom to have a triangular cross section. On the top surface of the base part 41*x* is formed a recess portion 41*b* and the lower end of the movable part 42 is fit in the recess portion 41*b*.

The movable part 42 is an annular metal member and is movable in orthogonal directions with respect to the head holder 3. The movable part 42 is connected with the lip elevating motor 44 (see FIG. 9) via a plurality of gears 43. When the lip elevating motor 44 is driven under control by the controller 1*p*, the movable part 42 ascended or descended along with the base part 41$x$. With ascending or the descending of the movable part 42, the projecting part 41$a$ is positioned to an abutting position (see FIG. 5) where the leading end 41$a$1 can abut the glass table 8 (surface 8$a$) or a detached position (see FIG. 6) where the leading end 41$a$1 is detached from the surface 8$a$. While the head 10 is in the printing position, the leading end 41$a$1 of the projecting part 41$a$ in the abutting position abuts the surface 8$a$, thus separating the ejection space S1 from the external space S2. At this point, the ejection space S1 is sealed. In the detached position, the ejection space S1 is opened to the external space S2 and not sealed.

Figure 7:
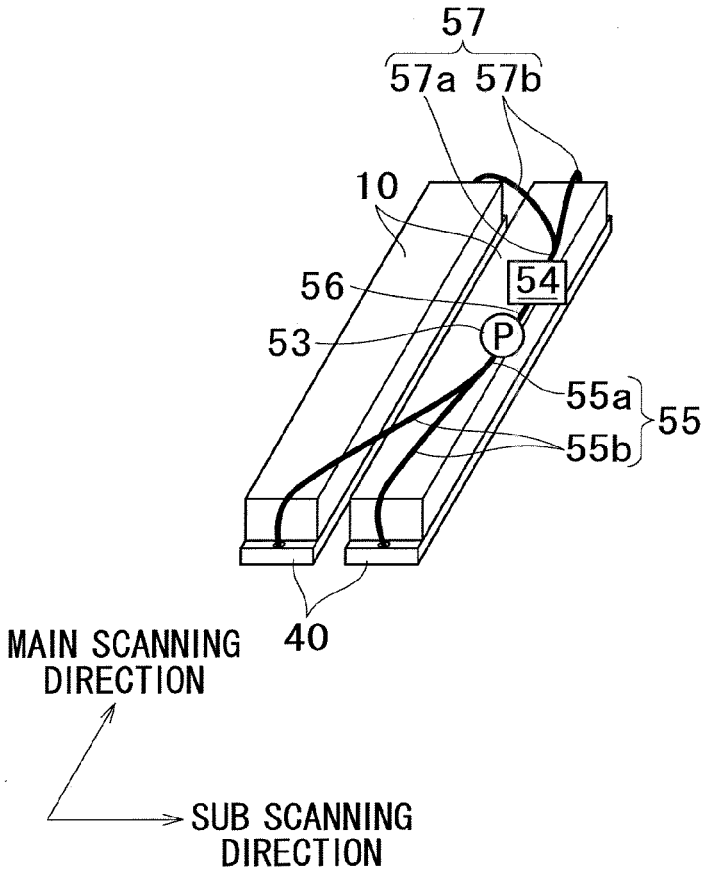
FIG. 7 is a schematic view showing how all the heads and humidifier are connected in the printer shown in FIG. 1.

Next, the following describes the structure of the humidifier 50, with reference to FIG. 5 and FIG. 7.

As shown in FIG. 5, the humidifier 50 includes the joints 51, tubes 55, 56, 57, a pump 53, and a tank 54. There are two joints 51 for each head 10. On the other hand, the pump 53 and the tank 54 are shared by the two heads 10 as shown in FIG. 7. The tubes 55 and 57 have main portions 55$a$ and 57$a$ shared by the heads 10. Each of the main portions 55$a$ and 57$a$ is branched into two branched parts 55$b$ (57$b$) which extend to the joints 51.

One ends (the leading end of each branch unit 55$b$) of the tube 55 are fit to the joints 51 (left of FIG. 5), respectively, and the other end (and end portion of the main portion 55$a$ opposite to the branch unit 55$b$) of the tube 55 is connected to the pump 53. The tube 56 is connected to the pump 53 and the tank 54. One ends (the leading end of each branch unit 57$b$) of the tube 57 are fit to the other one of the joints 51 (right of FIG. 5), respectively, and the other end (and end portion of the main portion 57$a$ opposite to the branch unit 57$b$) of the tube 57 is connected to the tank 54.

The tank 54 stores water in its lower space and humidified air in its upper space. The tube 56 is connected to a portion of the tank 54 (lower space) which is lower than the surface level of the water in the tank 54, the tube 57 is connected to a portion of the tank 54 (upper space) which is higher than the surface level of the water in the tank 54. The tube 56 has a not-shown check valve so that the air flows only in the direction of the arrow shown in FIG. 5.

Next, the following describes the wiper-moving mechanism 60. As shown in FIG. 8A and FIG. 8B, the wiper-moving mechanism 60 is provided to each of the heads 10. The wiper-moving mechanism 60 has a wiper 61, a wiper holder 60$a$, a pair of guides 60$b$, and a wiper moving motor 63 (see FIG. 9). The wiper holder 60$a$ supports the wiper 61 and is movable along the guides 60$b$. The guides 60$b$ extend in the main scanning direction and sandwiches the head 10 in directions parallel to the sub scanning direction. The wiper 61 is a blade made of an elastic material, and is disposed so that its length is parallel to the sub scanning direction. Driving the wiper moving motor 63 reciprocates the wiper holder 60$a$ along the guides 60$b$. When the wiping operation is not performed, the wiper 61 is disposed in a standby position. The standby position is a position nearby the left end of the head 10 in FIG. 8A and FIG. 8B.

Figure 8C:
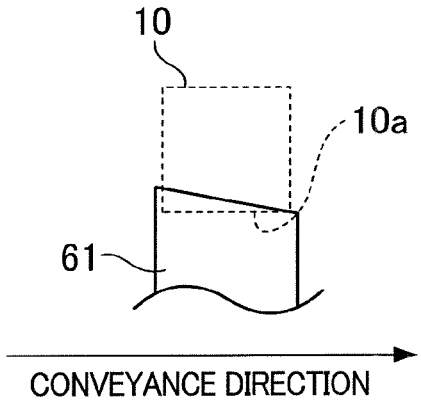

As shown in FIG. 8C, the upper end portion of the wiper 61 has a tilt such that the height of the wiper 61 relative to a direction perpendicular to the ejection surface 10$a$ is the highest at the upstream end relative to the conveyance direction. In the present embodiment, during the wiping operation, the upstream end of the wiper 61 relative to the conveyance direction is disposed nearby a position where the upstream end of the wiper 61 surfaces the upstream end of the ejection surface 10$a$. Thus, in the wiping operation in which the wiper 61 moves in a direction perpendicular to the paper surface of FIG. 8C, the pressure of pressing the wiper 61 against the ejection surface 10$a$ is higher at the upstream end of the wiper 61 whose upper end portion is at the highest position, as compared with the pressure at the downstream of the wiper 61. This is effective in removing the condensed matter of the ink and the pre-coat liquid.

Next, the following describes the controller 1$p$. The controller 1$p$ includes a CPU (Central Processing Unit), a non-volatile semiconductor memory storing programs to be run by the CPU and data to be used in the programs, and a RAM (Random Access Memory) for temporarily storing data when running the program. The hardware and the software in the non-volatile memory in combination constitute functional parts structuring the controller 1$p$. As shown in FIG. 9, the controller 1$p$ has a head control unit 71, a maintenance control unit 72, a jam determining unit 73, and a jam counter 74.

The head control unit 71 controls the plurality of actuator units 17 in the image forming operation and the flushing operation. The image forming operation involves ejection of the droplets (the ink droplets and the pre-coat droplets) based on the image data. This ejection is synchronized with the conveyance of the sheet P, and is performed at a predetermined timing based on an output signal (leading end detection signal) from a sheet sensor. The flushing operation involves ejection of the droplets based on the flushing data.

The jam determining unit 73 is connected to the jam detection sensors 76 disposed along with the sheet conveyance path. Two sensors 76 out of them are disposed in positions immediately upstream and downstream of the two heads 10 along the sheet conveyance path. Each sensor 76 detects the leading end of the sheet, and outputs a detection signal to the jam determining unit 73 of the controller 1$p$. The jam determining unit 73 determines sheet jamming has occurred when sheet detection signals are not received at predetermined time intervals based on the spacing distance between the both sensors 76 and the conveyance speed of the sheet P. The jammed sheet may cause adhesion of the pre-coat liquid to the side surface (mainly the side surface facing the upstream) of the head 10 for ejecting the ink. The sensor 76 positioned upstream serves as the above-described sheet sensor, and the leading end detection signal therefrom determines the droplet ejection timing. In the present embodiment, the jam determining unit 73 and the plurality of jam detection sensor 76 constitute the jam detector.

The jam counter 74 stores the number of times jamming has occurred. When the jam determining unit 73 determines that jamming has occurred, the jam counter 74 increments the count by 1. When the later-mentioned jam purge operation group is executed, the jam counter 74 resets the count to zero.

The maintenance control unit 72 controls the holder elevating motor 68, the heads 10, the purge pump 69, the wiper moving motor 63, the lip elevating motor 44, the humidifier 50, the pump 53, and the reversing mechanism 7 so as to perform the maintenance including the flushing operation, the purge operation, the wiping operation, and the humidifying operation. The heads 10 are controlled by the maintenance control unit 72 via the head control unit 71. Each operation of the maintenance is described below.

The flushing operation starts immediately before the start of printing and at every predetermined period after the start of printing. When the flushing operation is started, the maintenance control unit 72 drives the plurality of actuator units 17 of each head 10, and causes droplets to be forcedly ejected from at least a part of the ejection openings 14$a$. The droplets are ejected to the glass table 8, or the sheet P in the process of printing. In the latter case, the heads 10 ejects minimum size of droplet (e.g., 4 pl) so as to restrain deterioration of the image quality. The flushing droplets are ejected to a portion of the sheet P where dots for the image are not formed.

The purge operation is started after the sheet P jammed in the sheet conveyance path is removed, and immediately before the start of printing. When the purge operation is started, the maintenance control unit 72 controls the holder elevating motor 68 to bring the heads 10 in the printing position, and controls the reversing mechanism 7 to cause the glass table 8 to surface the ejection surface 10*a*. After this, the maintenance control unit 72 controls the purge pump 69 to pump the liquid (the ink or the pre-coat liquid) to the heads 10. This causes all the ejection openings 14*a* to forcedly discharge the liquid. The discharged liquid is collected to a not-shown waste liquid tank via the glass table 8.

Figure 10A:
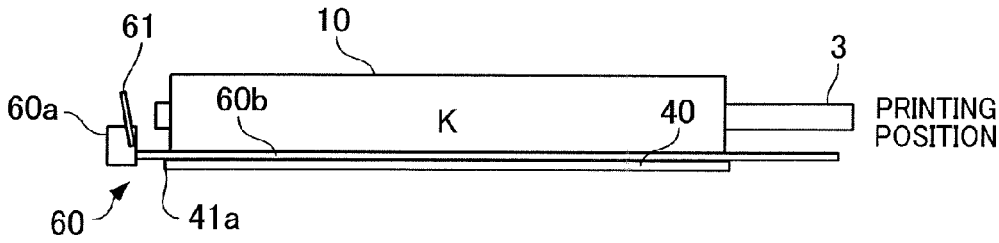
FIGS. 10A, 10B, 10C are each a side view showing a sequence of the wiping operation in the printer shown in FIG. 1.
Figure 10B:
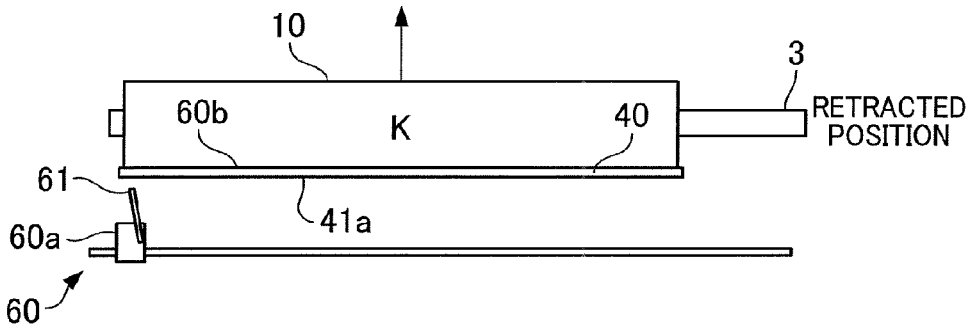
Figure 10C:
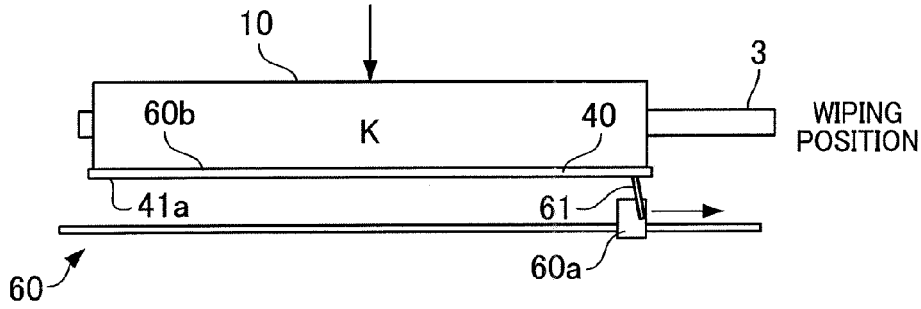

The wiping operation is performed subsequently to the flushing operation author the purge operation. Immediately before the wiping operation, the heads 10 are in the printing position as shown in FIG. 10A. When the wiping command is received, the maintenance control unit 72 controls the holder elevating motor 68 to bring the heads 10 in the retracted position as shown in FIG. 10B, and controls the lip elevating motor 44 to bring each projecting part 41*a* in the detached position. The wiper-moving mechanism 60 is driven in this state so that each wiper 61 moves to position immediately before the corresponding ejection surface 10*a*, passing immediately under the projecting part 41*a*. The maintenance control unit 72 at this point descends the heads 10 to bring them in the wiping position as shown in FIG. 10C. Further, the wiper-moving mechanism 60 is driven so that each wiper 61 horizontally moves while contacting the ejection surface 10*a*. As shown in FIG. 8B, the wiping direction is a direction from the standby position on the left towards the right of the figure. After the ejection surfaces 10*a* are wiped, the maintenance control unit 72 temporarily brings the heads 10 to the retracted position. After the wipers 61 are moved to the standby position, the heads 10 are brought back to the printing position to complete the wiping operation.

Figure 11:
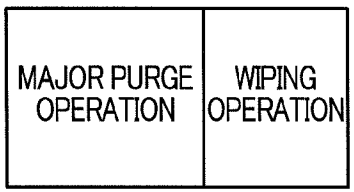
FIG. 11 is an explanatory diagram of maintenance at a time of jamming in the printer shown in FIG. 1.
Figure 11:
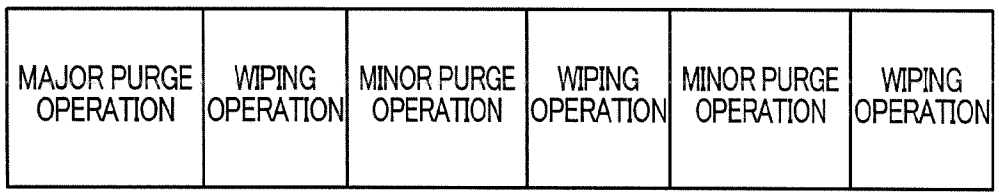

Further, when the sheet P jams in the sheet conveyance path (when the jam determining unit 73 determines that jamming has occurred), the maintenance control unit 72 successively executes the purge operation and the wiping operation, after detecting the completion of the jam process, i.e., removal of the sheet P by the user (e.g., an operation of opening/closing the housing 1*a* by the user or an operation of a predetermined button by the user). FIG. 11 shows two exemplary purge operation groups with different numbers of purge operations and different numbers of wiping operations. In FIG. 11, (a) shows a normal purge operation group including a single purge operation and a single wiping operation, and (b) shows a jam purge operation group including a combination of the purge operation and the wiping operation, the combination being performed three times in a row.

Usually, when the jam process is completed, the normal purge operation group is executed as the maintenance. In the purge operation (major purge operation) executed first in the normal purge operation group, a total of approximately 2 ml (large amount) of liquid is forcedly discharged from all the ejection openings 14*a*. The jam purge operation group is the maintenance executed every three times of the jam processes, and the purge operation and the wiping operation are executed twice more each in addition to those executed in the normal purge operation group. In the purge operations of the second and the third times minor purge operations), the amount of liquid discharged is less than that of the first time, and is approximately 1 ml (small amount). In the jam purge operation group, the amount of ink ejection is gradually reduced every purge operation. Further, with the decrease in the amount of liquid forcedly discharged, the wiping speed by the wiper 61 (the moving speed of the wiper 61) in the wiping operations of the second and the third times are made slower than the wiping operation of the first time. That is, in the jam purge operation group performing the purge operation more than once, the wiping speed in the wiping operations of the second time and thereafter is made slower than the wiping operation of the first time. As should be understood from the above, the maintenance control unit 72 stores "3" as a threshold related to the jam process, and compares this threshold with the count stored in the jam counter 74. When they do not match with each other, the normal purge operation group is executed, and when the threshold and the count match with each other, the jam purge operation group is executed.

When the sheet P on which the pre-coat liquid is applied jams before completely traversing the head 10(K) for recording, the pre-coat liquid may adhere to the side surface of the head 10(K) for recording which surfaces the upstream. Recurrence of the jam more than once raises a concern of not only accumulation of the pre-coat liquid, but also spreading of the pre-coat liquid to the ejection surface 10*a* which may cause defective ejection. This problem caused by spreading of the pre-coat liquid is prevented in the present embodiment by performing the maintenance involving the jam purge operation group once every three times of the jam processes.

The humidifying operation is an operation for humidifying the ejection space S1 in the sealed state (capped state), and is started after printing is completed. Note that during the following series of operations in the humidifying operation, the heads 10 are disposed in the printing position. Further, the glass table 8 is disposed to surface the ejection surfaces 10*a* by the reversing mechanism 7.

When the humidifying operation is started, the maintenance control unit 72 first moves the movable part 42 by rotating the gears 43. The projecting parts 41*a* move from the detached position (see FIG. 6) during the printing to the abutting position (see FIG. 5). This way, the projecting parts 41*a* abut the glass table 8, thus sealing the ejection space S1. Note that the maintenance control unit 72 moves the projecting parts 41*a* to keep the ejection space S1 in the sealed state during the standby state and during an inactive state where printing does not take place.

The maintenance control unit 72 drives the pump 53 to circulate the humidified air. When the pump 53 is driven, the air in the ejection space S1 is collected via the opening 51*a*, and the humidified air is supplied to the space S1 via the opening 51*b*. At this time, the collected air flows to the lower space of the tank 54 via the tubes 55 and 56. The air is humidified by the water in the lower space and stored in the upper space. The humidified air stored has a humidity of substantially 100%. The humidified air in the upper space further flows to the opening 51*b* via the tube 57. The maintenance control unit 72 stops the pump 53 after a predetermined period. With the supply of this humidified air, the ink inside the cap 40 is humidified and thickening of the ink in the ejection openings 14*a* is restrained. Further, the condensed matter formed on the ejection surface 10*a* is also humidified. This facilitates removal of the matter by the wiping operation.

In FIG. 5, the black arrow indicates the flow of the air before being humidified, and the outlined arrow indicates the flow of humidified air. The maintenance control unit 72, while driving the pump 53, controls a not-shown switch valve or the like provided to the branched parts 55*b* and 57*b* shown in FIG. 7 so as to selectively adjust the air flow in the branched parts 55*b* and 57*b*.

Figure 12:
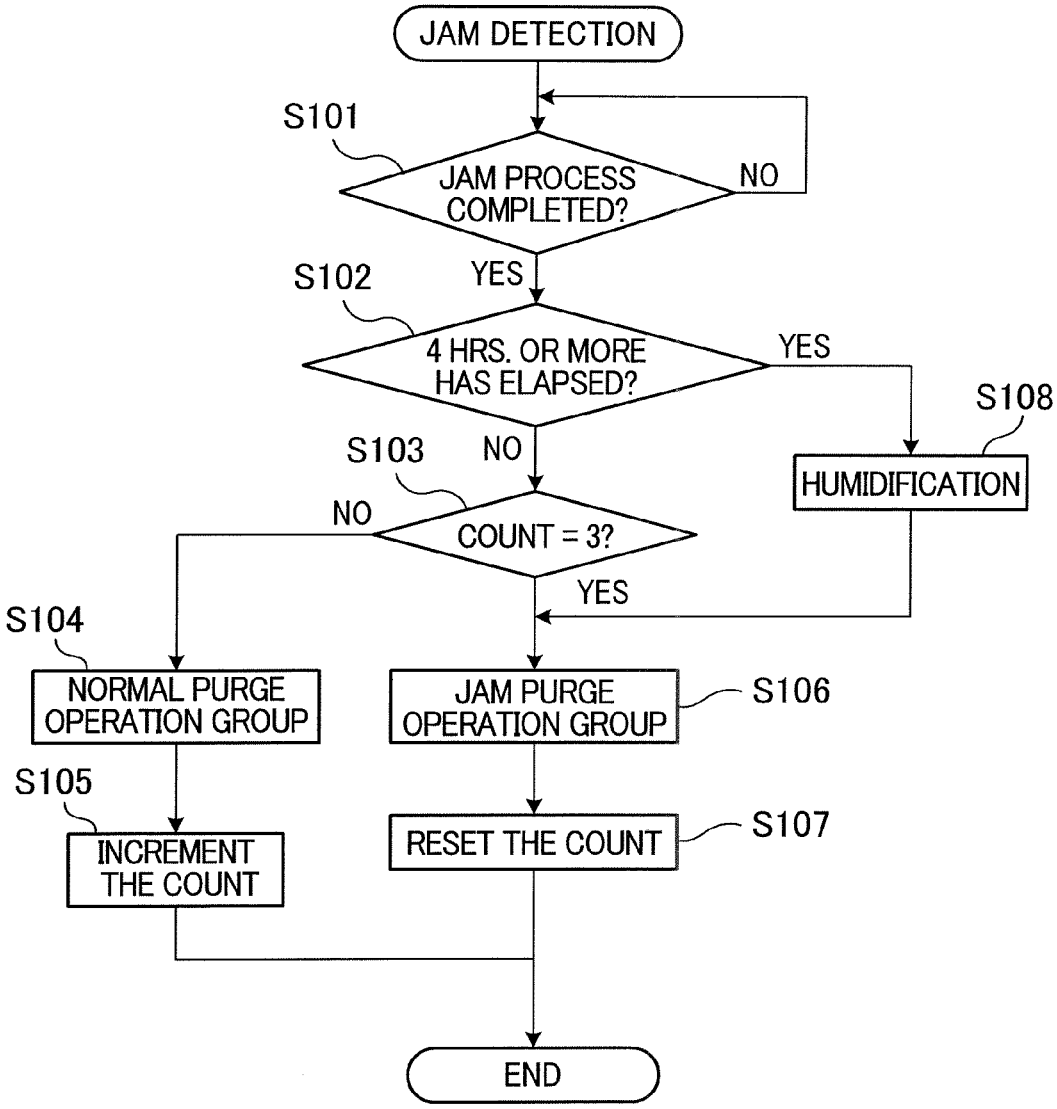
FIG. 12 is a flowchart of the maintenance at the time of jamming in the printer shown in FIG. 1.

Next, the following describes an operation of the printer 1 when the sheet P is jammed, with reference to FIG. 12. When the jam determining unit 73 detects jamming of the sheet P, the maintenance control unit 72 stands by until the jam process by the user to remove the sheet P is completed (S101: NO). When the jam process is completed (S101: YES), the maintenance control unit 72 determines whether four hours or more have elapsed from the jamming of the sheet P (S102).

The maintenance control unit 72, when determining that four hours or more have not yet elapsed (S102: NO), determines whether the count is 3 (S103). When the count is determined as not to be 3 (S103: NO), the maintenance control unit 72 executes the maintenance involving the normal purge operation group (S104). Then, the count on the jam counter 74 is incremented by 1 (S105), and the flowchart of FIG. 12 ends. On the other hand, when the count is determined as to be 3 (S103: YES), the maintenance control unit 72 executes the maintenance involving the jam purge operation group (S106). Then, the count on the jam counter 74 is reset to zero (S107), and the flowchart of FIG. 12 is ended.

The maintenance control unit 72, when determining that four hours or more have elapsed after the jamming of the sheet P (S102: YES), executes the humidifying operation (S108) and then executes the maintenance involving the jam purge operation group (S106). Then, the count on the jam counter 74 is reset to zero (S107), and the flowchart of FIG. 12 is ended.

As described, in the printer 1 of the present embodiment, when the jamming of the sheet P occurs three times, the number of the purge operations and the number of wiping operations are increased more than those in cases where the jamming occurs once or twice no that, even if the pre-coat liquid remains on the side surface of the head 10(K), the effect of the remaining pre-coat liquid is reliably removed from the ejection surface 10*a*. Further, when the jamming of the sheet P occurs once or twice, the number of purge operations is less than that in cases where the jammings occurs three times. This restrains the ink consumption.

Further, in the jam purge operation group, the total amount of liquid discharged from all the ejection openings 14*a* is gradually reduced every purge operation. This restrains an increase in the consumption of the liquid related to the purge operation. In addition, wetting the ejection surface 10*a* by the purge operation before the wiping operation restrains the ejection surface 10*a* from being damaged by the wiping operation.

Further, when the jam purge operation group is executed, the moving speed of the wiper the wiping operations the second and the third times is lowered than that in the wiping operation of the first time. This enables efficient wiping of the ejection surface 10*a* while restraining damages to the ejection surface 10*a*.

Further, the cap 40 enables covering of the ejection surface 10*a* and a part of the side surface of the head 10(K). This prevents the remaining pre-coat liquid on the side surface of the head 10(K) from being dried and firmly fixed.

At this time the humidifying operation is performed, which reliably restrains the pre-coat liquid remaining on the side surface of the head 10(K) from being dried and firmly fixed.

Further, the height of the upper end portion of the wiper 61 relative to the direction perpendicular to the ejection surface 10*a* has a tilt such that its upstream end relative to the conveyance direction is the highest during the wiping operation. This efficiently removes the pre-coat liquid remaining on the upstream side surface of the head 10(K).

Second Embodiment

The following describes a second embodiment. The present embodiment is different from the first embodiment in the structure of the cap mechanism and the jam purge operation group related to the maintenance control unit. Therefore, the following only describes the structure of the cap mechanism and the jam purge operation group related to the maintenance control unit. Other members and functional parts are given the same reference numerals as those of the first embodiment, and further description is omitted.

Figure 13:
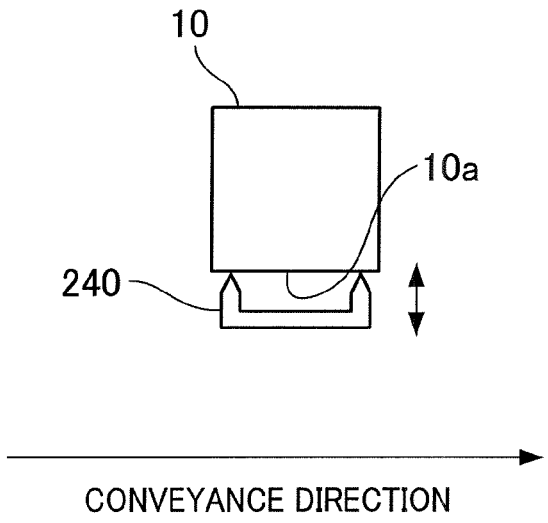
FIG. 13 is a partial cross sectional view of explaining a cap mechanism in the inkjet printer related to a second embodiment of the present invention.

In the above first embodiment, the cap 40 is structured to surround the entire ejection surface 10*a* of the corresponding head 10; however, a cap 240 of the second embodiment has a bottom plate which is apart from the head 10 and an annular projection projecting upward from the outer edge portion of the bottom plate, as shown in FIG. 13. The cap 240 is movable to an abutting position where the leading end of the annular projection abuts the ejection surface 10*a* and a detached position where the leading end separates from the ejection surface 10*a*, by a not-shown cap moving mechanism. While the cap 240 is in the abutting position, the cap 240 only covers an area of the ejection surface 10*a* where the ejection openings 14*a* are formed. At this time, the edge portion of the ejection surface 10*a* is exposed to the outside the cap 240. Therefore, the pre-coat liquid remaining on the side surface of the head 10(K) is also exposed to the outside the cap 240. The viscosity of the pre-coat liquid remaining on the side surface of the head 10(K) therefore varies depending on the humidity of the external air.

Figure 14:
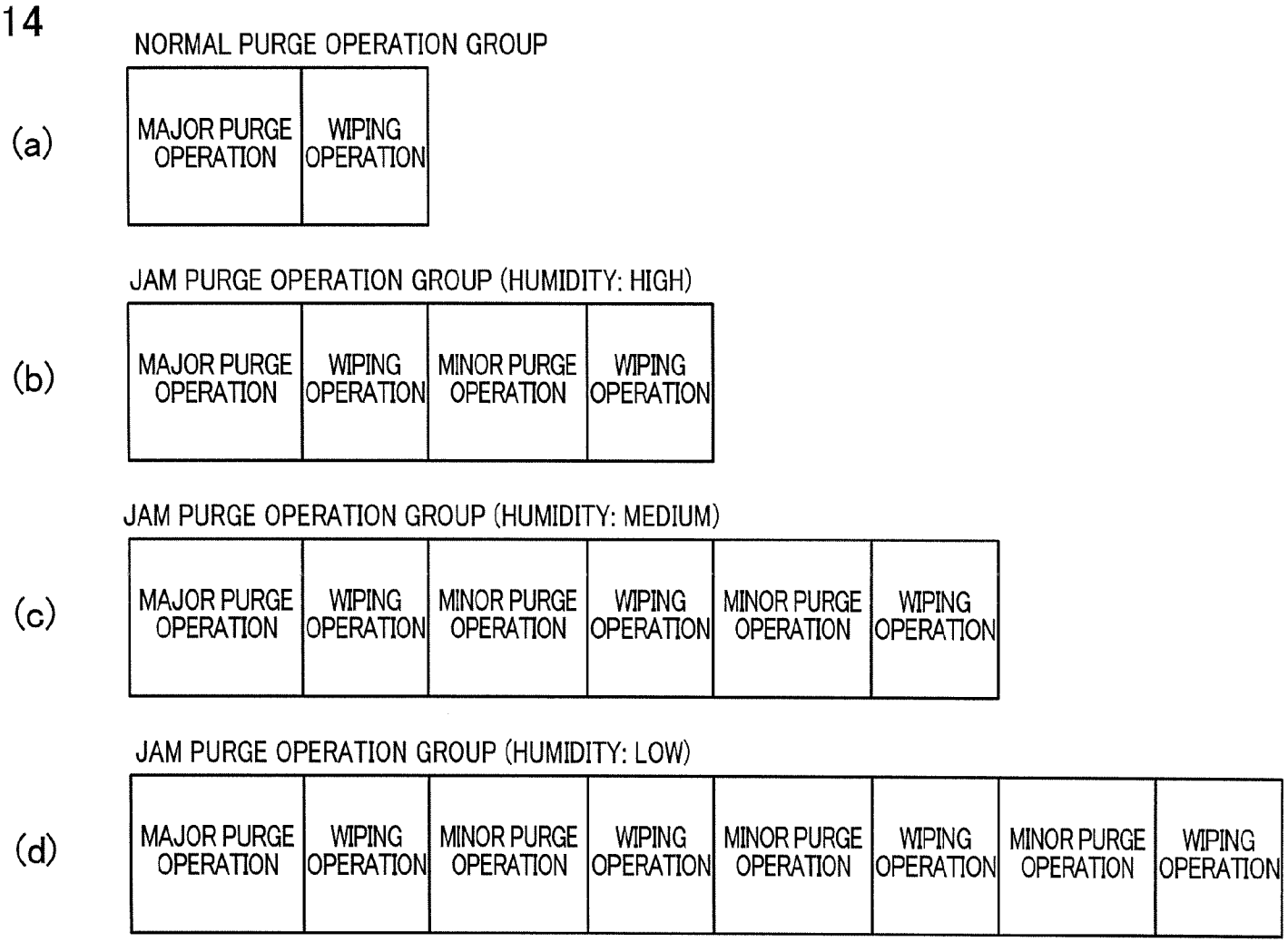
FIG. 14 is an explanatory diagram of maintenance at the time of jamming in the printer shown in FIG. 13.

For this reason, in the present embodiment, the maintenance control unit varies the jam purge operation group based on the detection result by a not-shown humidity sensor. Specifically, the maintenance control unit, when executing the normal purge operation group, causes forced discharging of a total of 2 ml (large amount) of liquid from all the ejection openings 14*a* in the purge operation, and then executes the wiping operation (see (a) of FIG. 14).

In the jam purge operation group on the other hand, if the humidity is over 80% (high humidity), the maintenance control unit, in the first purge operation (major purge operation), causes forced discharging of a total of 2 ml (large amount) of liquid from all the ejection openings 14*a*, and then executes the wiping operation. Then, in the subsequent purge operation (minor purge operation), the maintenance control unit causes forced discharging of 1 ml (small amount) of liquid, and then executes the wiping operation (see (b) of FIG. 14). If the humidity is 20% or higher but not more than 80% (medium humidity), the maintenance control unit, in the purge operation (major purge operation) of the first time, causes forced discharging of a total of 2 ml (large amount) of liquid from all the ejection opening 14*a* and then executes the wiping operation. Then, the maintenance control unit repeats a set of operations twice, which includes a purge operation (minor purge operation) causing forced discharging of 1 ml (small amount) of liquid, and the wiping operation executed thereafter (see (c) of FIG. 14). Further, if the humidity is less than 20% (low humidity), the maintenance control unit, in the purge operation (major purge operation) of the first time, causes forced discharging of a total of 2 ml (large amount) of liquid and then executes the wiping operation. Subsequently, the maintenance control unit repeats a set of operations three times, each set including a purge operation (minor purge operation) causing forced discharging of 1 ml (small amount) of liquid and the wiping operation executed thereafter (see (d) of FIG. 14). As should be understood, the number of purge operations and the number of wiping operations in the jam purge operation group are reduced with an increase in the humidity. As a modification, it is possible to reduce only the number of wiping operations, out of the purge operations and the wiping operations in the jam purge operation group, with an increase in the humidity.

As described, in the printer of the present embodiment, the number of the purge operations and the number of the wiping operations are increased when the jamming of the sheet P occurs three times, as compared to those in cases where the jamming occurs once or twice so as to reliably eliminate the effect of the pre-coat liquid on the side surface of the head 10(K), i.e., restrain spreading of the pre-coat liquid to the ejection surface 10*a*. It is therefore possible to restrain the subsequent jamming from causing the pre-coat liquid remaining on the side surface of the head 10(K) to migrate to the ejection openings 14*a* of the head 10(K). Further, when the jamming of the sheet P occurs once or twice the number of purge operations is less than that in cases where the jammings occurs three times. This restrains the ink consumption.

Further, the cap 240 is structured to cover only a part of the ejection surface 10*a*. This enables downsizing of the cap mechanism.

Further, in the jam purge operation group, the number of purge operations and the number of wiping operations are reduced with an increase in the humidity. Reduction of the purge operations and the wiping operations executed restrains damages to the ejection surface 10*a* and the wiper 61, and an increase in the liquid consumption.

Modification of Second Embodiment

In the present modification, the threshold of the count of jamming of the sheet P for executing the jam purge operation group is increased with a decrease in the humidity. This is because, lower the humidity, the less likely that the pre-coat liquid remaining on the side surface of the head 10(K) migrates to the ejection opening 14*a*. For example, if the humidity is over 80% (high humidity), the jam purge operation group is executed every two jammings of the sheet P. If the humidity is 20% or higher but not higher than 80% oncdioro humidity), the jam purge operation group is executed every three jammings of the sheet P. If the humidity is less than 20% (low humidity), the jam purge operation group is executed every four jammings of the sheet P. With this, the number of times the jam purge operation group is executed is reduced with a decrease in the humidity. This restrains damages to the ejection surface 10*a* and the wiper 61, and an increase in the liquid consumption.

<Other Modifications>

In the above two embodiments, the jam purge operation group is performed when jamming of the sheet P occurs three times. However, the jam purge operation group may be executed when the jamming of the sheet P occurs twice or any higher number of times. Further, in the above-mentioned two embodiments, the count on the jam counter 74 is reset to zero every time the jam purge operation group is performed. However, resetting of the count to zero is not necessary. When not resetting the count, there is a plurality of thresholds for determining whether to execute the jam purge operation group, and the count is compared with these thresholds to determine whether the count matches with any one of the thresholds. The minimum threshold is preferably 2 or greater, and the difference between one of the thresholds and an immediately previous or subsequent threshold is 2 or greater. Further, the differences among the thresholds are preferably the same.

Further, in the above-mentioned two embodiments, the purge operation and the wiping operation are performed more than once in the jam purge operation group. However, the purge operations of the second time and thereafter may be partially omitted in the jam purge operation group. In other words, the jam purge operation group may be such that, of the purge operation and the wiping operation, at least the number of wiping operations performed is more than that in the normal purge operation group.

Further, in the above-mentioned two embodiments, the amount of liquid discharged is gradually reduced every purge operation in the jam purge operation group. However, the amount of liquid discharged in the purge operation of the jam purge operation group may be any given amount. For example, the amount of liquid discharged may be reduced every purge operation.

Further, in the jam purge operation group of the above-mentioned two embodiments, the moving speed of the wiper 61 in the wiping operations of the second and the third times is made slower than that of the wiping operation of the first time. However, the moving speed of the wiper 61 in each wiping Operation in the jam purge operation group may be any given speed. For example, the moving speed may be successively lowered every wiping operation.

Further, in the above-mentioned two embodiments, the printer 1 has the humidifying function. However, the printer 1 does not necessarily have the humidifying function. In the above-mentioned two embodiments, the facing member is the glass table 8; however, the facing member may be the platen 9 or any other given member, instead of the glass table 8.

Further, in the above-mentioned two embodiments, the height of the wiper 61 relative to a direction perpendicular to the ejection surface 10*a* has a tilt such that its portion nearby a position to surface the upstream end of the ejection surface 10*a* during the wiping operation is the highest. However, the shape of the wiper may be any given shape provided that the ejection surface 10*a* can be wiped. For example, the upper end portion of the wiper may be parallel to the ejection surface 10*a*.

In addition, in the above-mentioned two embodiments, the printer 1 has two heads 10; however, the printer may have three or more heads 10.

Further, in the above-mentioned two embodiments, the head 10 positioned the most upstream relative to the conveyance direction is the head for ejecting the pre-coat liquid. However, that head 10 may be a head 10 that ejects ink droplets of a color different from the droplets ejected from the head downstream. Alternatively, it is possible to provide a liquid applying member such as a roller for applying the pre-coat liquid. That is, in the present invention, the wording "apply" related to the pre-coat liquid encompasses the meaning of "eject".

Application of the present invention is not limited to the printer, and may be applicable to facsimiles, photocopiers, or the like. Further, the present invention may be applied to a product that ejects a liquid other than ink.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An image recording apparatus, comprising:

a conveyor configured to convey a recording medium in a conveyance direction;

an application unit configured to apply a first liquid to the recording medium;

a liquid ejection head having a liquid ejection surface on which liquid ejection openings for ejecting a second liquid to the recording medium are opened, which is provided downstream of the application unit relative to the conveyance direction;

a force-discharger configured to cause forced discharging of the second liquid from the liquid ejection openings;

a wiping mechanism configured to wipe the liquid ejection surface;

a jam detector configured to detect jamming of the recording medium in the conveyor;

a jam counter configured to count the number of times the jamming has been detected by the jam detector; and a controller configured to control the force-discharger and the wiping mechanism so that, when the jam detector detects the jamming, the forced discharging and the wiping are executed after the jammed recording medium is removed from the conveyor, wherein the controller controls the force-discharger and the wiping mechanism so that, when the count on the jam counter matches with any of one or more thresholds, at least the number of times the wiping is executed after the jammed recording medium is removed from the conveyor is greater than that executed when the count on the jam counter does not match with any of one or more thresholds.

2. The image recording apparatus according to claim 1, wherein the controller controls the force-discharger so that, when the count on the jam counter matches with any of the one or more thresholds and if the number of times the forced discharging is executed is twice or more, the amount of second liquid discharged in the forced discharging of the second time and thereafter is less than the amount of second liquid discharged in the forced discharging of the first time.

3. The image recording apparatus according to claim 2, wherein the controller controls the force-discharger so that, when the count on the jam counter matches with any of the one or more thresholds and if the number of times the forced discharging is executed is twice or more, the amount of second liquid discharged from the liquid ejection openings by the force-discharger is gradually reduced every forced discharging.

4. The image recording apparatus according to claim 3, wherein the controller controls the force-discharger so that, a speed of the wiping for the forced discharging executed latest is slower than that for the forced discharging executed earliest.

5. The image recording apparatus according to claim 1, further comprising:

a cap configured to abut the liquid ejection surface to cover the liquid ejection openings; and a moving mechanism configured to move the cap between an abutting position where the cap abuts the liquid ejection surface and a detached position where the cap is detached from the liquid ejection surface.

6. The image recording apparatus according to claim 5, further comprising a humidity sensor configured to detect the humidity, the controller increases the one or more thresholds with a decrease in the humidity detected by the humidity sensor.

7. The image recording apparatus according to claim 5, further comprising:

a humidity sensor configured to detect the humidity, wherein when the count matches with any of the one or more thresholds, the controller performs control so that at least the number of wiping to be executed is reduced with an increase in the humidity detected by the humidity sensor.

8. The image recording apparatus according to claim 1, further comprising:

a facing member configured to surface the ejection surface over an ejection space facing the ejection surface;

a cap made having a lip made of an elastic material which surrounds the liquid ejection head and a connecting part made of an elastic material which connects the lip with the liquid ejection head; and a moving mechanism configured to move the cap between an abutting position where the lip abuts the facing member and a detached position where the lip is detached from the facing member.

9. The image recording apparatus according to claim 8, further comprising:

a humidifier configured to supply a humidified air to the ejection space while the lip is in the abutting position.

10. The image recording apparatus according to claim 1, wherein the wiping mechanism includes: a wiper and a wiper-moving mechanism configured to move the wiper along the ejection surface, in a direction perpendicular to the conveyance direction; and the wiper is shaped so that its height relative to a direction perpendicular to the liquid ejection surface is the highest at a portion nearby a position facing an upstream end of the liquid ejection surface relative to the conveyance direction, while the wiping is performed.

11. The image recording apparatus according to claim 1, wherein the first liquid acts on the second liquid ejected to the recording medium so as to condense or extract a component in the second liquid.

12. The image recording apparatus according to claim 1, wherein the one or more thresholds are set so that a minimum threshold is 2 or greater, and when the number of the thresholds is more than one, a difference between one of the thresholds and an immediately previous or subsequent threshold is 2 or greater.

13. An image recording apparatus, comprising:

a conveyor configured to convey a recording medium in a conveyance direction;

an application unit configured to apply a first liquid to the recording medium;

a liquid ejection head having a liquid ejection surface on which liquid ejection Openings for ejecting a second liquid to the recording medium are opened, which is provided downstream of the application unit relative to the conveyance direction;

a force-discharger configured to cause forced discharging of the second liquid from the liquid ejection openings;

a wiping mechanism configured to wipe the liquid ejection surface;

a detection sensor configured to detect the presence and absence of the recording medium; and a controller configured to control the force-discharger and the wiping mechanism, wherein the controller determines that the recording medium has jammed based on a detection result by the detection sensor, counts the number of times the jamming has been detected, controls the force-discharger and the wiping mechanism so that, when jamming of the recording medium is determined to have occurred, the forced discharging and the wiping are executed after the recording medium is removed from the conveyor, controls the force-discharger and the wiping mechanism so that, when the count on the jam counter matches with any of one or more thresholds, at least the number of times the wiping is executed after the jammed recording medium is removed from the conveyor is greater than that executed when the count on the jam counter does not match with any of one or more thresholds.

* * * * *